US009415841B2

(12) United States Patent
Morimoto

(10) Patent No.: US 9,415,841 B2
(45) Date of Patent: Aug. 16, 2016

(54) LNG SHIP

(76) Inventor: Nobuyoshi Morimoto, Tokyo (JP)

( * ) Notice: Subject to any disclaimer, the term of this patent is extended or adjusted under 35 U.S.C. 154(b) by 0 days.

(21) Appl. No.: 14/237,532

(22) PCT Filed: Aug. 13, 2012

(86) PCT No.: PCT/JP2012/070594

§ 371 (c)(1),
(2), (4) Date: Apr. 3, 2014

(87) PCT Pub. No.: WO2013/024835

PCT Pub. Date: Feb. 21, 2013

(65) Prior Publication Data

US 2014/0224169 A1 Aug. 14, 2014

(30) Foreign Application Priority Data

Aug. 13, 2011 (JP) ..... 2011-177360
Sep. 12, 2011 (JP) ..... 2011-197904

(51) Int. Cl.
*B63B 25/16* (2006.01)
*B63B 3/20* (2006.01)
*F17C 13/08* (2006.01)

(52) U.S. Cl.
CPC . *B63B 25/16* (2013.01); *B63B 3/20* (2013.01); *F17C 13/082* (2013.01); *B63B 2241/10* (2013.01); *F17C 2260/016* (2013.01); *F17C 2270/0105* (2013.01)

(58) Field of Classification Search
CPC ..... B63B 25/16; B63B 3/20; B63B 25/12; B63B 25/08; F17C 13/08; F17C 13/082
USPC ..... 114/74 R, 74 T
See application file for complete search history.

(56) References Cited

U.S. PATENT DOCUMENTS

| | | | | |
|---|---|---|---|---|
| 3,356,251 | A * | 12/1967 | Roberts | 114/74 R |
| 3,507,242 | A * | 4/1970 | Eberhard | 114/74 R |
| 3,583,351 | A | 6/1971 | Gorman | |
| 3,851,611 | A | 12/1974 | Yamamoto | |
| 2011/0011329 | A1 | 1/2011 | Kim et al. | |

FOREIGN PATENT DOCUMENTS

| | | | |
|---|---|---|---|
| EP | 0 619 221 | A2 | 10/1994 |
| FR | 2 181 073 | A1 | 11/1973 |
| JP | 45-8380 | B1 | 3/1970 |
| JP | 49-129290 | | 11/1974 |
| JP | 2011-513140 | A | 9/1994 |
| JP | 2011-513140 | A | 4/2011 |
| KR | 10 2011 0050007 | A | 11/1973 |
| WO | WO 2009/067017 | A1 | 5/2009 |

* cited by examiner

*Primary Examiner* — Lars A Olson
(74) *Attorney, Agent, or Firm* — Muncy, Geissler, Olds & Lowe, P.C.

(57) ABSTRACT

Provided is a LNG storage tank of a membrane type mounted on a LNG-FPSO or a LNG carrier, wherein volumetric efficiency is high and sloshing does not easily occur at the time of heavy weather. In order to solve this problem, a membrane-type tank is composed of a main tank under a deck and a box-shaped head tank on the deck. These main and head tanks communicate with each other via a hole opened in the deck to form one tank. The main tank is formed by forming a heat insulation layer on inner sides of a double bottom and left and right longitudinal bulkheads and further by liquid-tightly covering the top by a membrane of Invar or the like. Similarly, the head tank also has a heat insulation layer and a membrane provided on its inner surface.

6 Claims, 4 Drawing Sheets

LNG SHIP

TECHNICAL FIELD

The present invention relates to a LNG ship including a tank for storing LNG (liquefied natural gas). The term "LNG ship" is used as including not only a LNG carrier for carrying LNG from a place where it is produced to a place where it is consumed but also a LNG-FPSO (Floating LNG Production, Storage and Off-Loading system) in which a LNG storage tank and a LNG liquefaction plant are mounted on a barge and a LNG-FSRU (Floating LNG Storage and Re-gasification Unit) in which a LNG storage tank and a re-gasification plant are mounted on a barge.

BACKGROUND ART

Under circumstances where the price of energy is rising worldwide, development projects of a large-scale gas field of seabed far from land are currently beginning in earnest. A LNG-FPSO used for this has functions of liquefying gas, which is produced from a gas field of seabed, on the ocean to produce LNG, storing the LNG in a tank, and loading it onto a LNG carrier. (Note that a LNG-FSRU has a function of gasifying LNG received from a LNG carrier to deliver the LNG to the land.)

The LNG-FPSO includes a tank for storing a large amount of the produced LNG, and as its tank structure, LNG tank technology, which has been fostered in the construction of a conventional LNG carrier, is expected to be adopted. However, since how the LNG storage tank is used is different between the LNG-FPSO and the LNG carrier, care is needed. In the case of the LNG carrier, a phenomenon that a liquid cargo in the tank violently sloshes (sloshing phenomenon) is unlikely to occur even at the time of heavy weather because the LNG storage tank is used either in full load condition or in unload condition and is never in half load condition. Only at the time of a cargo handling work, a liquid level in the tank greatly changes, but since the cargo handling work has been usually performed in a port where waves and winds are quiet, it has been possible to almost disregard the sloshing.

On the other hand, in the LNG-FPSO, the sloshing phenomenon is thought to be likely to occur because it is constantly moored on the ocean where a weather condition is severe and a liquid level in its LNG storage tank changes from time to time according to a production amount of LNG and a loading amount to the LNG carrier, and half load condition daily occurs. Another important thing about the LNG-FPSO is that loading the liquid cargo to the LNG carrier with the use of a loading arm by STS (ship to ship), in particular, while the LNG carrier is alongside the LNG-FPSO (side by side) is now under consideration. Considering that the cargo handling for a conventional LNG carrier has been performed while the LNG carrier is is moored at a berth provided in a safe port, it is thought that the aforesaid STS cargo handling on the ocean has a high risk, and a collision accident occurs between the LNG-FPSO and the LNG carrier trying to approach it to damage the hull, or an accident such as the damage of the hull could occur due to leakage of the liquid cargo from the loading arm. Therefore, in designing the tank of the LNG-FPSO, it is necessary to take such risks into full consideration.

Further, it is also necessary to take it into consideration that a future LNG carrier is loaded with LNG from a LNG-FPSO on the ocean where the weather condition is severe, and in particular, a measure against the sloshing during the loading is required.

LNG storage tanks conventionally used in LNG carriers include a self-supporting spherical tank (MOSS type tank), a self-supporting prismatic tank (SPB type), and a membrane tank, and it is expected that one of these three tank types will be adopted also in the LNG-FPSO. Firstly, regarding the self-supporting spherical tank, it is a self-supporting tank made of an aluminum alloy and is supported in a hold formed by a double hull, via a skirt extending from its equatorial portion. A heat insulation layer is applied on an outer surface of the tank (external thermal insulation). Due to its spherical shape, the self-supporting spherical tank has a disadvantage of low volumetric efficiency because it is not well fitted in the hold. In the tank of this type, owing to its external thermal insulation, the heat insulation layer does not suffer damage even when a cargo sloshes at the time of heavy weather.

In the self-supporting prismatic tank, a main body is a prismatic tank made of an aluminum alloy and strength members reinforcing the tank are provided on an inner side of the tank, and a heat insulation layer is provided on an outer surface of the tank. This type requires void space between the prismatic tank and an inner hull of the ship, which accordingly reduces volumetric efficiency of the tank. On the other hand, since the strength is members can be provided inside the tank, sloshing of a liquid cargo does not easily occur at the time of heavy weather, and even if the sloshing occurs, the heat insulation layer provided on the outer surface of the tank is not damaged.

Regarding the membrane type, on an inner surface of a hold fabricated with a double hull structure, thin sheets (membranes) made of nickel steel or stainless steel are affixed, with a heat insulation layer therebetween, to form a LNG tank. This type is excellent in volumetric efficiency because almost all the volume of the hold can be used as a tank volume. On the other hand, it has a disadvantage that the membranes and the heat insulation layer are likely to be damaged by the sloshing of a liquid cargo. It also has a problem that a thermal insulation work, in particular, the welding of the membranes is complicated and it requires a long period for the construction.

SUMMARY OF THE INVENTION

Technical Problem

This invention relates to a LNG ship mainly having a membrane-type LNG storage tank (that is, a LNG carrier, a LNG-FPSO, a LNG-FSRU), and has an object to provide one which is excellent in volumetric efficiency of the tank and in which sloshing of a liquid cargo does not easily occur at the time of heavy weather.

Means for Solving the Problem

The LNG ship of this invention has a LNG storage tank of a membrane type or a self-supporting prismatic type (SPB type). These LNG storage tanks are each composed of a main tank formed in a space of each quarter surrounded by a multiple hull and a box-shaped head tank provided on a deck right above the main tank and smaller in width than the main tank. A characteristic lies in that these main and head tanks communicate with each other to form one tank.

As described above, since not only the main tank formed in the space of each quarter but also the box-shaped head tank on the deck are included, it is possible to obtain a large tank volume without making a hull itself large. Further, the head tank is smaller in width than the main tank thereunder, which has an advantage that sloshing does not easily occur when a liquid level of a cargo reaches the head tank. In order to obtain a sufficient effect of reducing the sloshing, the width of the head tank is preferably within a range of about 50 to about 70 percent of the width of the main tank. The head tank does not have a sufficient volume when it is short, while becoming structurally unstable when it is tall, and therefore, the height of the head tank is preferably within a range of 20 percent to 60 percent of the width of the same tank.

The hull can have a double hull structure, and the main tank can be formed in a space surrounded by the double hull structure and an upper deck. More specifically, left and right longitudinal bulkheads can be provided in the space surrounded by the double hull structure and the upper deck, by doing so, the space can be divided into three sections, namely, a center section and left and right side sections by the longitudinal bulkheads, and the main tank can be formed in the center section. In this structure, since the main tank is protected by the triple hull structure (that is, an outer board, an inner hull, and the longitudinal bulkheads), it is possible to reduce a risk of the main tank being damaged even in such a case where the hull is damaged due to a collision accident with another ship.

In the case of the LNG-FPSO, the left and right side sections formed by the triple hull structure can be used effectively as a condensate tank storing a bi-product such as LPG produced in a production process of LNG or as a freshwater tank. In the case of the LNG carrier, the left and right side sections are used as ballast tanks, and used for draft adjustment and for the adjustment of a rolling period of the hull by increasing/decreasing an amount of seawater ballast.

In this LNG ship, the LNG storage tank is of the membrane type, and when violent sloshing occurs, a membrane and a heat insulator are likely to be damaged due to a pressure of a violently sloshing liquid cargo. On the other hand, in an independent LNG storage tank, since a heat insulation layer is on an outer surface of the tank, the heat insulation layer is not easily damaged even when the sloshing occurs. For the sloshing, a position of a level the liquid cargo in the tank is important, and it is thought that, when the liquid level is between 20 percent to 80 percent of the depth of the tank, the sloshing easily occurs and it is dangerous. Therefore, it is not preferable that all LNG storage tanks are of the membrane type, and it is preferable that at least one independent-type LNG storage tank, for example, an independent-type self-supporting tank (Moss type) or an independent-type prismatic tank (SPB type) is added. In case that such an independent-type tank is used in the LNG-FPSO, LNG produced by a LNG production plant is stored in this independent-type tank and then, when a considerable amount of the LNG is stored, all the stored LNG is transferred to the membrane tank at once. By doing so, it is possible to prevent the liquid level in the membrane tank from staying in a dangerous liquid level zone for a long time.

DESCRIPTION OF EMBODIMENTS

Figure 1:
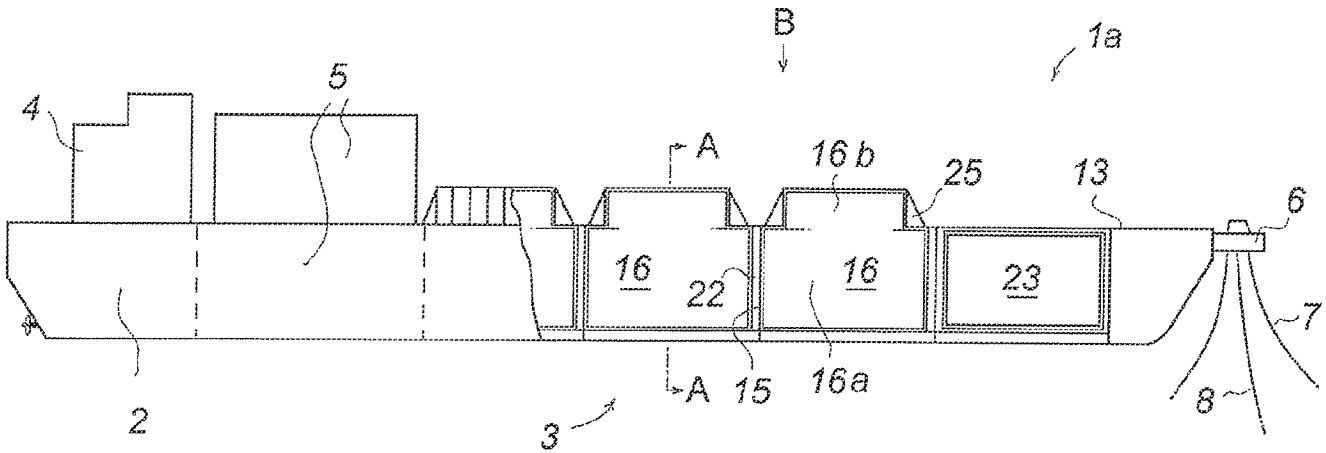
FIG. 1 is a schematic side view of a LNG-FPSO.

FIG. 1 is a side view of a LNG-FPSO denoted by reference sign 1*a*, is according to this invention. Note that this ship is remodeled from a ship which is originally a ship exclusive for crude oil/ore. Of course, it can be newly built from the first. In its stern, there is an engine room 2, and an area in front of the engine room 2 is a tank space 3. In the rear of an upper deck, there is an accommodation area 4, and in front thereof, a LNG production plant 5 is mounted. On a bow part, a turret 6 that a LNG-FPSO commonly has is provided, and a mooring wire rope 7 extending from an anchor fixed to the bottom of the sea is connected to this turret to perform various kinds of works in a single-point mooring state. A riser pipe 8 rising from the bottom of the sea is also connected to the turret, and natural gas collected from a gas field is sent through this pipe to the LNG production plant 5 on board. The natural gas is refined and liquefied here and sent to and stored in several LNG storage tanks 16, 23 provided in the tank space 3. For the delivery of the stored LNG, a LNG carrier is set alongside the LNG-FPSO (1*a*), and a liquid cargo is loaded onto the LNG carrier by using a loading arm (not shown) provided on the upper deck.

Figure 3:
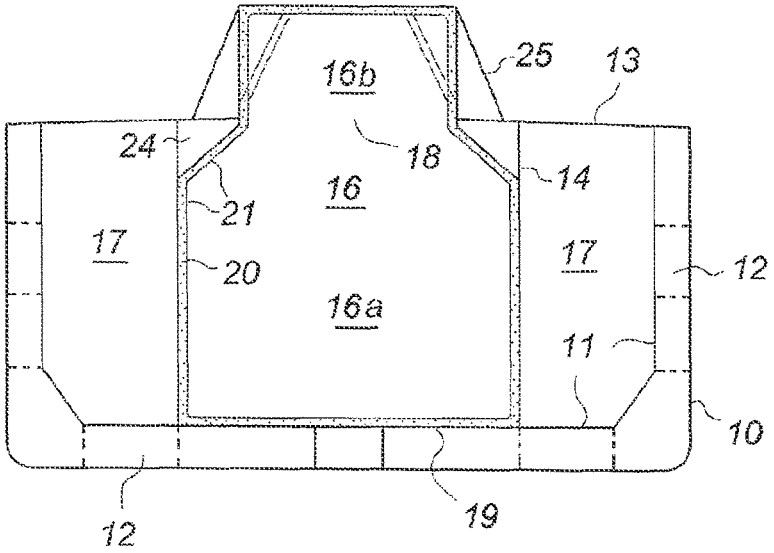
FIG. 3 is a cross-sectional view of a hull taken along A-A line in FIG. 1 or FIG. 4.

FIG. 3 is a cross-sectional view of a center tank part of the LNG-FPSO, and a double hull structure composed of an outer hull 10 and an inner hull 11, which was included in the ship exclusive for crude oil/ore before the remodeling, is used as it is, and a space 12 between the outer hull and the inner hull is used as a seawater ballast tank. A space surrounded by the inner hull 11 and the upper deck 13 is partitioned into several sections by a pair of left and right longitudinal bulkheads 14 and several transfer bulkheads 15 as originally was in the ship exclusive for crude oil/ore. Center-array sections formed between the left and right bulkheads 14 were originally holds for the crude oil and ore, and by using these sections, several membrane type LNG storage tanks 16 are formed. Left and right-array sections 17 (originally crude oil tanks) are used as storage spaces of freshwater, condensate, and so on.

The membrane-type tanks 16 are each composed of a main tank 16*a* under the deck and a box-shaped head tank 16*b* on the deck. When this ship was exclusive for crude oil/ore, a hatch (hatchway) for loading ore was opened in the upper deck, and a hatch coaming stood to surround the hatchway. At the time of the remodeling, a side wall is extended upward so as to be added to this hatch coaming and a ceiling is provided, whereby the head tank 16*b* is formed. The head tank formed in this manner communicates with a hole 18 (originally the hatchway) opened in the deck to form one tank together with the main tank.

The main tank 16*a* is formed by forming a double bottom 19 and a heat insulation layer 20 on inner sides of the left and right longitudinal bulkheads 14 and by liquid-tightly covering the top by a membrane 21 of Invar or the like. The reference sign 24 denotes a void space formed on a lower side of the upper deck 13. Note that between the front and rear LNG tanks, a cofferdam 22 is provided so as to be surrounded by the two transfer bulkheads (see FIG. 1 and FIG. 2). The head tank 16*b* also has on its inner surface a heat insulation layer 20 and a membrane 21.

The reference sign 25 denotes a reinforcing bracket provided around the head tank.

Note that the head tank 16*b* can also be formed to have a trapezoidal cross section, with its side board being inclined as shown by the chain line in FIG. 3.

The LNG storage tank 16 of this LNG ship is characterized in that the head tank 16*b* is added on the deck right above the main tank 16*a*. A first merit of this is that the whole tank can have a large volume. An about 15 to 25 percent volume increase can be expected as compared with a case where only the main tank is provided. A second merit is that as a result of adding the head tank to the main tank, the whole shape of the tank becomes a bottle-like shape, and since the head tank is smaller in lateral width than the main tank, there is an effect that sloshing is difficult to occur when the level of the liquid cargo is located at a position high enough to reach the head tank.

As shown in FIG. 1, this ship includes only one self-supporting LNG storage tank 23 at the foremost part, and the self-supporting LNG tank may be a spherical tank (MOSS type), but here a prismatic tank (SPB type) is adopted. This self-supporting tank is intended to prevent the level of the liquid cargo in the membrane-type LNG storage tanks 16 from staying in the sloshing dangerous zone as described above.

Figure 2:
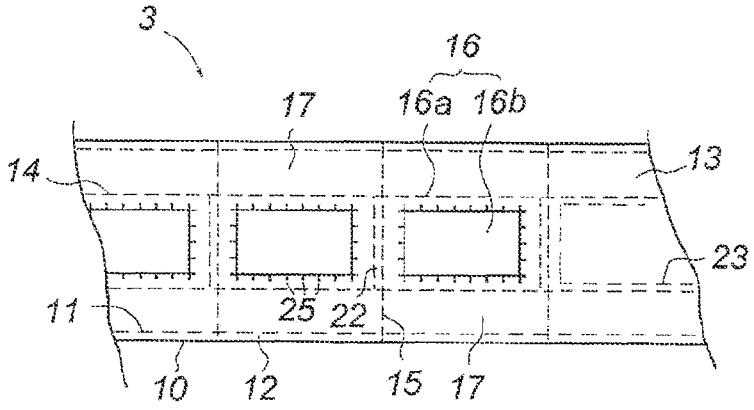
FIG. 2 is a plane view of an upper deck seen from the direction B in FIG. 1 or FIG. 4.
Figure 4:
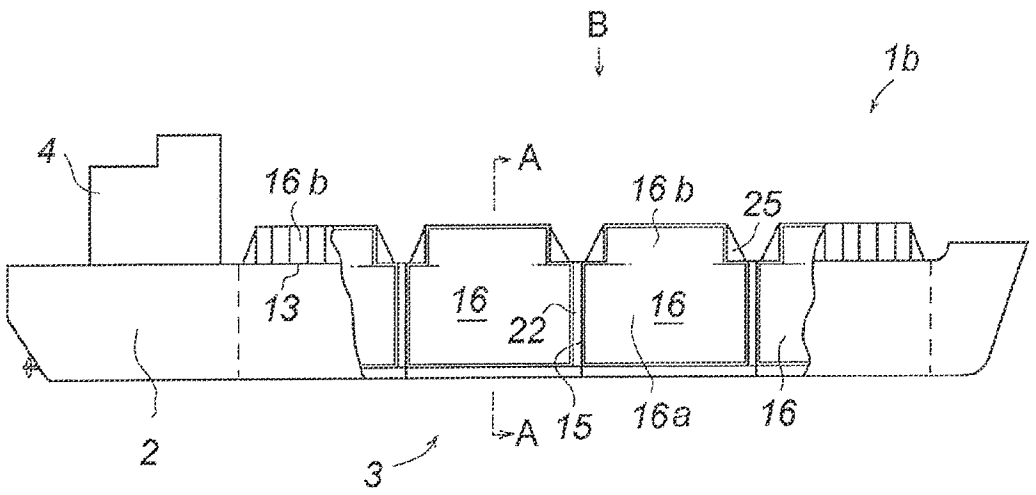
FIG. 4 is a schematic side view of a LNG carrier.

FIG. 4 is a side view of a LNG carrier 1*b* according to this invention (not having a production facility 5). This LNG carrier is also remodeled from a ship exclusive for crude oil/ore, but may be newly built from the first. This LNG carrier has none of the LNG production plant 5, the turret 6, and the independent LNG tank 23 at the foremost part, but except for this, it has the same structure as that of the above-described LNG-FPSO. A center tank part of the LNG carrier is also the same as that of the aforesaid LNG-FPSO and is as shown in FIG. 2 and FIG. 3 described previously. The left and right-array sections 17 (originally crude oil tanks) are used as storage spaces of freshwater, condensate, and so on in the LNG-FPSO, but they are used as deep tanks for loading ballast in this LNG carrier.

When the LNG carrier is loaded with LNG from a LNG-FPSO on the ocean, a measure against the sloshing is required also in the LNG carrier because the liquid level in the LNG tank changes from zero to an almost fill-up level. As the measure, these ballast deep tanks 17 are useful. Conventionally, when a liquid cargo is loaded in unload condition, the loaded liquid cargo is gradually pooled from the bottom of the LNG tank, and therefore, the center of gravity of the ship tends to be low in the beginning. Specifically, the ship becomes a bottom-heavy state and its natural rolling period becomes small and the ship easily rolls, which causes a risk of the liquid cargo violently sloshing in the LNG tank. (However, when the loading progresses thereafter, the liquid level in the LNG tank becomes higher, so that the center of gravity of the ship also becomes higher and the rolling is subdued.)

In the present LNG ship, prior to the loading of the LNG, a sufficient amount of seawater is put in the ballast tanks, and during the loading of the LNG, the seawater in the ballast tanks 17 is discharged outboard little by little. This can avoid the bottom-heavy state, reduce the rolling of the ship, and suppress the sloshing.

Additionally there is another effect in the present LNG ship that a loading arm can be prevented from receiving an excessive force during the loading work where the LNG-FPSO gradually floats up while the LNG carrier gradually sinks. Precisely, the seawater ballast previously loaded in the deep ballast tanks 17 is gradually discharged during the loading work, which enables to reduce a relative vertical displacement of the both ships and to prevent the excessive force applied to the loading arm.

Figure 5:
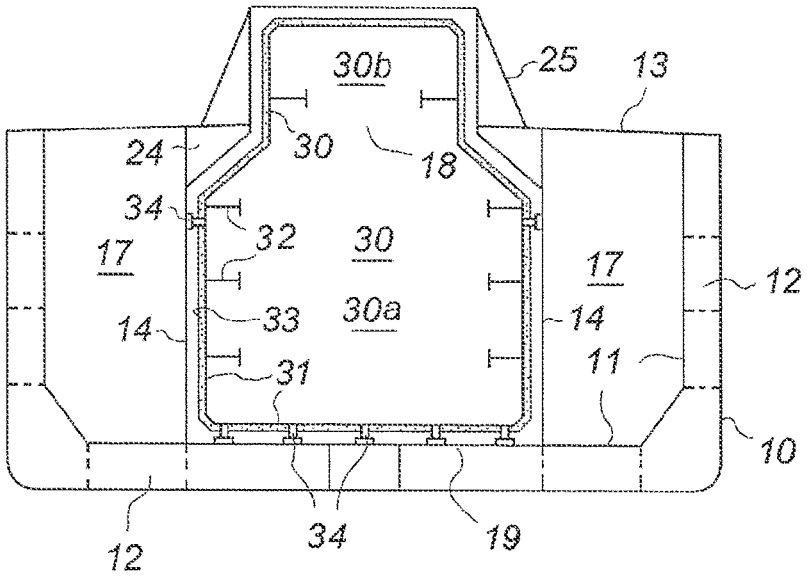
FIG. 5 is a cross-sectional view of a LNG ship equipped with an SBP tank.

FIG. 5 is a LNG ship in which a LNG storage tank 1 is configured by a self-supporting prismatic (SPB-type) tank 30 instead of the membrane tank 16. A tank shape, similarly to the membrane tank in FIG. 3, is composed of a main tank 30*a* under a deck and a head tank 30*b* on the deck. Strength members 32 reinforcing tank walls 31 are provided on inner surfaces of the tank and a heat insulation layer 33 is formed on outer surfaces of the tank. The reference sign 34 denotes support blocks supporting a bottom portion and side portions of the tank. Thus adopting the self-supporting prismatic tank instead of the membrane tank has an advantage that the sloshing does not easily occur at the time of heavy weather. Further, spaces are formed between the tank walls 31 and longitudinal bulkheads 14, so that the longitudinal bulkheads are not susceptible to a low-temperature influence from the LNG tank, which has a merit of widening a range where high-tension steel is usable as the longitudinal bulkheads.

BRIEF DESCRIPTION OF REFERENCE

1 LNG ship
1*a* LNG-FPSO
1*b* LNG carrier
10 outer hull
11 inner hull
13 upper deck
14 longitudinal bulkhead
15 transfer bulkhead
16 LNG storage tank
16*a* main tank
16*b* head tank
17 left and right side sections
18 hole
23 self-supporting prismatic LNG tank
30 self-supporting prismatic LNG tank
30*a* main tank
30*b* head tank

The invention claimed is:

1. A LNG ship comprising a LNG storage tank of a membrane type only as a LNG storage tank, wherein the tank is composed of a main tank formed in a space of each quarter surrounded by a multiple hull and a box-shaped head tank provided so as to extend above an upper deck right above the main tank and smaller in width than the main tank, and the main tank and the head tank communicate with each other via a hole opened in the upper deck and the main tank and the head tank are tanks of membrane type, each of which has a heat insulation layer provided on an inner surface of a tank wall and a membrane covering liquid-tightly the beat insulation layer;

wherein a width of the head tank is within a range of 50 percent to 70 percent of the width of the main tank; and wherein a height of the head tank is within a range of 20 percent to 60 percent of the width of the head tank.

2. The LNG ship according to claim 1, wherein left and right longitudinal bulkheads are provided in a space surrounded by the multiple hull structure and the upper deck, the space is divided by the longitudinal bulkheads into three sections, namely, a center section and left and right side sections, and the main part tank is formed in the center section.

3. The LNG ship according to claim 2, wherein the side section is formed so as to be a condensate tank.

4. The LNG ship according to claim 2, wherein the side section is formed so as to be a deep tank for ballast.

5. The LNG ship according to claim 1, comprising a LNG production plant and being used as a LNG-FPSO.

6. The LNG ship according to claim 1 being used for carrying LNG.

* * * * *